US007810442B2

(12) United States Patent
Duarte et al.

(10) Patent No.: US 7,810,442 B2
(45) Date of Patent: Oct. 12, 2010

(54) MOORING/VESSEL SNAP HOOK DEVICE

(76) Inventors: Helder F. Duarte, 4 Andover Rd., Billerica, MA (US) 01821; Anthony A. Duarte, 7 Fairmount St., Lowell, MA (US) 01852

( * ) Notice: Subject to any disclaimer, the term of this patent is extended or adjusted under 35 U.S.C. 154(b) by 0 days.

(21) Appl. No.: 11/646,820

(22) Filed: Dec. 28, 2006

(65) Prior Publication Data

US 2008/0156245 A1 Jul. 3, 2008

(51) Int. Cl.
*B63B 21/00* (2006.01)

(52) U.S. Cl. ..... 114/230.2; 114/230.15; 114/230.25

(58) Field of Classification Search ..... 114/221 R, 114/223, 218, 230.25, 230.2, 230.26, 230.28, 114/230.3; 294/19.1, 82.17, 28.2; 24/600.9
See application file for complete search history.

(56) References Cited

U.S. PATENT DOCUMENTS

| | | | | | |
|---|---|---|---|---|---|
| 513,652 | A | * | 1/1894 | Reed et al. | 24/600.9 |
| 653,021 | A | | 7/1900 | Hamilton | |
| 741,014 | A | | 10/1903 | Covert | |
| 850,234 | A | * | 4/1907 | Lambert | 24/600.9 |
| 1,536,701 | A | * | 5/1925 | Buckingham et al. | 114/230.25 |
| 1,852,629 | A | * | 4/1932 | Sturges | 114/230.15 |
| 2,116,880 | A | | 8/1935 | Dee | |
| 3,273,928 | A | | 9/1966 | Wisniewski | |
| 3,467,046 | A | * | 9/1969 | Welton | 114/230.28 |
| 3,590,767 | A | * | 7/1971 | Dunbar | 114/230.25 |
| 3,646,645 | A | | 3/1972 | Bauer | |
| 3,918,758 | A | | 11/1975 | Fournier | |
| 4,093,293 | A | | 6/1978 | Huggett | |
| 4,279,062 | A | | 7/1981 | Boissonnet | |
| 4,529,388 | A | * | 7/1985 | Jones et al. | 441/3 |
| 4,557,214 | A | | 12/1985 | Molitor | |
| 4,595,223 | A | | 6/1986 | Hawie | |
| 4,932,700 | A | | 6/1990 | Hart | |
| 4,986,207 | A | | 1/1991 | Reed | |
| 5,190,330 | A | | 3/1993 | Dunham | |
| 5,381,749 | A | | 1/1995 | KLarson | |
| 5,477,801 | A | * | 12/1995 | Lawrence | 114/218 |

(Continued)

FOREIGN PATENT DOCUMENTS

GB 2209146 A * 5/1989

*Primary Examiner*—Ed Swinehart
(74) *Attorney, Agent, or Firm*—John H. Pearson, Jr., Esq.; Walter F. Dawson, Esq.; Pearson & Pearson, LLP.

(57) ABSTRACT

A snap hook device comprises a detachable pole attached to a snap hook having a side link for securing a rope. The snap hook is generally U-shaped with a sloped spring closure having a first end attached to a first end of the hook and a second end of the spring closure being coiled and resting against a side of a second end of the snap hook. The second end of the U-shaped hook comprises a collar for receiving the detachable pole. The snap hook device enables a boat operator when alone in the boat to remain in the cockpit area of the boat, and capture a chain under a mooring buoy. The operator then maneuvers the boat with a rope attached to a link of the snap hook wherein the rope extends via the bow to the boat operator in the cockpit, so that by pulling the rope, the bow is easily and safely turned to be adjacent to the mooring buoy for attaching a mooring line.

16 Claims, 7 Drawing Sheets

U.S. PATENT DOCUMENTS 5,740,751 A 4/1998 Peever
5,820,181 A 10/1998 Le Noach
5,967,575 A 10/1999 Blake
6,193,432 B1 2/2001 Kamfert
6,450,558 B1 9/2002 Ringrose
6,508,190 B1 1/2003 Norton

* cited by examiner

MOORING/VESSEL SNAP HOOK DEVICE

BACKGROUND OF THE INVENTION

Field of the Invention

This invention relates generally to a device for capturing a mooring buoy to attach a boat thereto and, in particular, to a snap hook device for capturing a chain under the mooring buoy from the safety of the boat's cockpit and being able to maneuver the bow of the boat to be adjacent to the mooring buoy by pulling a rope attached to the snap hook device.

Description of Related Art

Anyone who drives a boat and has had to use a mooring buoy knows the difficulties of attaching a mooring line between the mooring and the boat particularly in rough waters and particularly if there is no other person in the boat, as is often the case with pleasure boats in the 16 foot to 24 foot class. The attachment of the line between the mooring buoy and the bow of the boat requires the boat operator to leave a cockpit area and move to the bow area in order to make the mooring line connection to a bow eye or chock which is not always an easy thing to do due in the presence of wind, waves, current, and other nearby boats. Many boat operators often have to make several dangerous attempts to capture a mooring line of a mooring buoy by hanging off the bow of the boat.

There are many devices in the prior art for assisting a boater to grasp a ring on top of a mooring buoy. For example, U.S. Pat. No. 2,116,880 issued May 10, 1938 to H. D. Dee discloses a self-locking cable hook comprising a hook horn, a hook latch, a spring stem enclosed within the body of hook, a key rod which is a temporary handle for the hook causing the latch to open, and rotating the rod allows the rod to be released from the hook closing the latch. A rope is attached to the lower portion of hook. However, this cable hook is not suitable for quickly grasping a chain under a mooring buoy.

U.S. Pat. No. 4,595,223, issued Jun. 17, 1986 to Robert L. Hawie, shows a remote control line assembly for use when approaching a mooring comprising a triangular shaped carabiner having a narrow line attachment end to which is secured a tie line or rope and a hook end having a finger section and a rigid helical rod tool which opens and closes the finger section allowing the carabiner to enter or come out of the eye hole or ring on top of a buoy. However, this assembly does not disclose a coiled spring for opening and closing the hook and does not easily capture a chain under a moving buoy.

U.S. Pat. No. 4,932,700, issued Jun. 12, 1990 to Ronald D. Hart discloses a mooring line shackle comprising a main body member, a shackle pin and a blocking member. A hook support with a base section and an arm form an open portion for reception of a typical loop provided on a mooring buoy. A shackle pin has a cylindrical main body section provided at one end of a ring. A mooring buoy is secured to the shackle and a boat. The shackle assembly is secured to a boat hook and when the mooring loop is within the open portion of the main body member, the boat hook and blocking member are pulled away from the shackle assembly and the pin snaps closed. However, this device does not comprise a coiled spring for easily grasping a chain under a mooring and is primarily for grasping a mooring loop or ring on top of a mooring.

U.S. Pat. No. 5,190,330, issued Mar. 2, 1993 to Bill Dunham, discloses a tool for connecting a snap hook to a remote eye, for example, on the bow of a boat comprising a snap hook set into a hook channel portion of a hook holder. The hook holder is secured to one end of an elongated handle. A finger extends from hook holder and uses the handle to move the snap hook into engagement with a bow eye or the like. Contact of the bow eye and the snap finger moves the holding arm out of holding engagement with the snap finger. The bow eye enters into the hook throat. The hook also becomes free from the holding arm. This allows easy movement of the hook holder away from the hook. However, this tool is not designed to grab a chain hanging down to a weight under a mooring buoy.

U.S. Pat. No. 5,381,749, issued Jan. 17, 1995 to Virgil A. Larson, discloses a boat mooring hook comprising a rod or boat hook, a mooring line, a U-shaped securing member or buoy hook which is used by sliding the end of the boat hook within a tubular sleeve. The buoy hook is advanced through a buoy ring by the boater's moving the boat hook while still aboard the boat. Once the buoy hook is engaged on the buoy ring, the boat hook can be removed from the sleeve. An eye in the end of the buoy hook is used to attach the mooring line. However, this boat mooring hook is not suitable for grasping a chain under a mooring buoy.

SUMMARY OF THE INVENTION

Accordingly, it is therefore an object of this invention to provide an apparatus for safely mooring a boat by capturing a chain or rope under a mooring buoy without the operator leaving the cockpit of the boat until the bow of the boat is adjacent to the mooring buoy.

It is another object of this invention to provide an apparatus with a snap hook, rope, and detachable pole for safely capturing a chain or rope under a mooring buoy.

It is a further object of this invention to provide a snap hook device for a boat operator to safely capture a chain or rope under a mooring buoy while positioned in the cockpit of a boat and by means of a rope extending from a snap hook device to the bow of a boat and then back to the cockpit to enable the operator to maneuver the bow of the boat to be adjacent to the mooring buoy without the operator leaving the cockpit of the boat.

It is another object of this invention to provide a vessel boarding capture apparatus for an operator of a other suitable hardware on a vessel with a detachable telescoping pole having a rope attached to a hook located on one end of the pole and maneuver the boat tender adjacent to the vessel.

These and other objects are further accomplished by a snap hook device comprising a U-shaped hook, a spring closure positioned across an open portion of the U-shaped hook having a first end secured to a first end of the U-shaped hook, a second end of the spring closure comprises a coiled spring which rests again an inside surface of the U-shaped hook thereby closing the open portion of the U-shaped hook, a link attached to an outside surface of the U-shaped hook, a collar attached to a second end of the U-shaped hook and a pole attached to the said collar. The device comprises a rope attached to the link. The pole comprises a telescopic pole, and an extension portion of the pole comprises a hexagonal shape. The pole comprises means for connecting to the collar in a manner that is readily detachable. The collar, attached to a second end of the U-shaped hook, comprises means for enabling the pole to be attached and detached from the U-shaped snap hook.

The objects are further accomplished by an apparatus for assisting a boat operator in mooring a boat comprising a snap hook device extended by the boat operator for capturing a chain or rope under a mooring buoy, means for enabling a detachable pole to be separated from the snap hook device after the chain or rope is captured, and the snap hook device comprises a rope which extends to a bow of the boat then to the boat operator to enable the operator to maneuver the bow of the boat to be adjacent to the mooring. The boat comprises means for passing the rope through on the way to the operator. The snap hook device comprises a U-shaped hook having a spring closure. The spring closure comprises a first end attached to a first end of the U-shaped hook and a second end comprises a coiled spring which rests against an opposite side of the U-shaped hook. The extension portion of the pole comprises a hexagonal shape. The pole comprises a pair of clasp springs attached to opposite sides of a detachable end of the pole.

The objects are further accomplished by a method for providing a snap hook device comprising the steps of providing a U-shaped hook, positioning a spring closure across an open portion of the U-shaped hook having a first end secured to a first end of the U-shaped hook, providing a second end of the spring closure with a coil spring which rests against the inside surface of the U-shaped hook thereby closing the open portion of the U-shaped hook, providing a link on an outside surface of said U-shaped hook, attaching a collar to a second end of the U-shaped hook, and connecting a pole to the collar. The method comprises the step of attaching a rope to the link. The step of connecting a pole to the collar comprises the step of connecting a telescopic pole. The step of connecting a pole comprises the step of connecting a hexagonal shaped extension portion of the pole. The step of connecting a pole to the collar comprises the step of enabling the pole to be quickly detached from the U-shaped snap hook.

The objects are further accomplished by a method for assisting a boat operator in mooring a boat comprising the steps of capturing a chain or rope under a mooring buoy with a snap hook device extended by the boat operator, enabling a detachable pole to be separated from the snap hook device after the chain or rope is captured, and providing a rope on the snap hook device which extends to a bow of the boat then to the boat operator to enable the operator to maneuver the bow of the boat to be adjacent to the mooring. The method comprises the step of providing means on the bow for passing the rope through on the way to the operator. The method of capturing a chain or rope under a mooring buoy comprises the step of providing a U-shaped hook having a spring closure. The step of enabling a detachable pole to be separated from the snap hook comprises the step of providing an extension portion of the pole with a hexagonal shape and a pair of clasp springs attached at the end of and on opposite sides of the extension portion.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention.

The various objects, advantages and novel features of this invention will be more fully apparent from a reading of the following detailed description in conjunction with the accompanying drawings in which like reference numerals refer to like parts, and in which.

DESCRIPTION OF ILLUSTRATIVE EMBODIMENT

Figure 1:
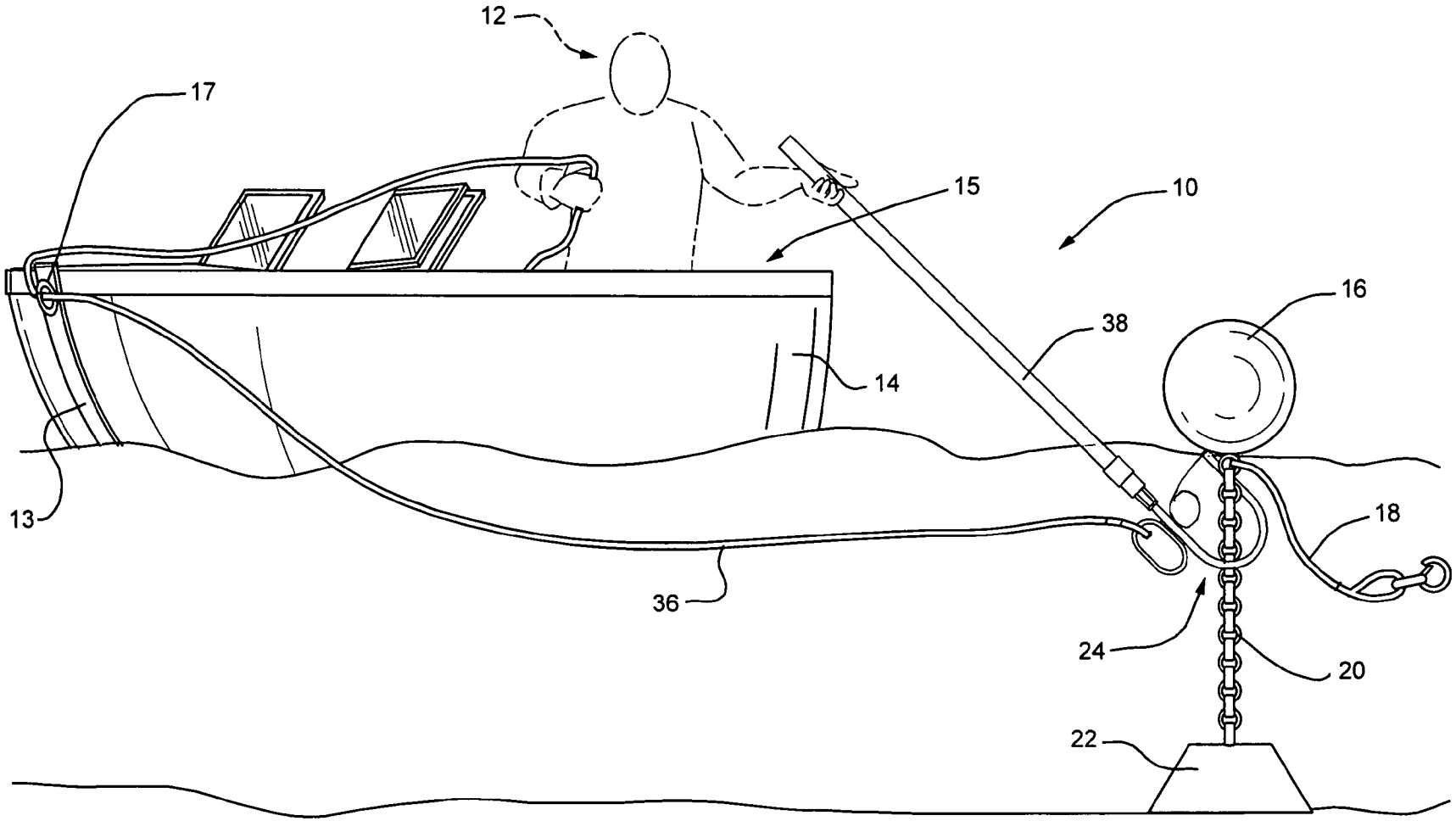
FIG. 1 illustrates a snap hook device capturing a chain of a mooring buoy from a cockpit of a boat according to the present invention.

Referring to FIG. 1, FIG. 1 shows a boat operator 12 in a cockpit area 15 of a boat 14 using a snap hook device 10 according to the present invention to capture A chain 20 attached under a mooring buoy 16 to facilitate bringing a bow 13 of the boat adjacent to the mooring buoy 16 and attaching a mooring rope 18 to a ring 17 or chock on the bow 13 of the boat 14.

Figure 2:
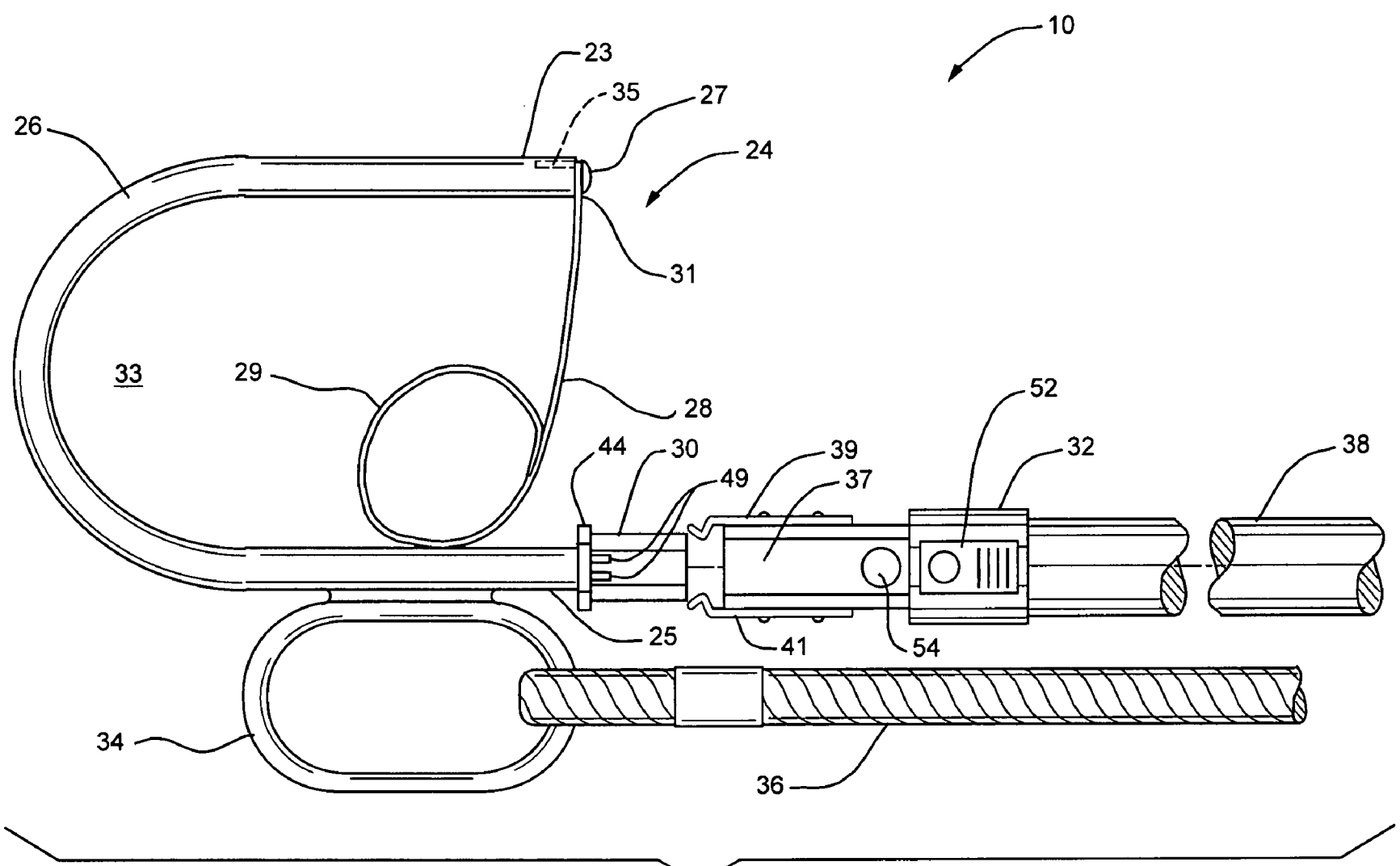
FIG. 2 is a side elevational view of a snap hook device according to the present invention.

Referring to FIG. 2, a side elevational view of the snap hook device 10 is shown comprising a U-shaped hook 26, a spring closure 28, a collar 30, a detachable pole 38, a link 34 and a rope 36. The spring closure 28 comprises a 90 degree bend on a first end 31 which fits into a slot 35 in the end 23 of the U-shaped hook 26, and the first end 31 is attached by a screw or bolt 27 to a first or nose end 23 of the U-shaped hook 26. The other end 29 of the spring closure 28 is coiled having a diameter of approximately 1.5 inches and rests against an inside surface of a second or body end 25 of the U-shaped hook 26. The rope 36, which may be embodied by 100 feet of nylon rope, is attached to the link 34, and the link 34 is attached to the side of the U-shaped hook 26 by welding for a distance of approximately 2.25 inches. The U-shaped hook 26 is embodied by a 9/16 inch 304 stainless steel rod and the link 34 is embodied by a 7/16 inch 304 stainless steel rod.

Figure 3:
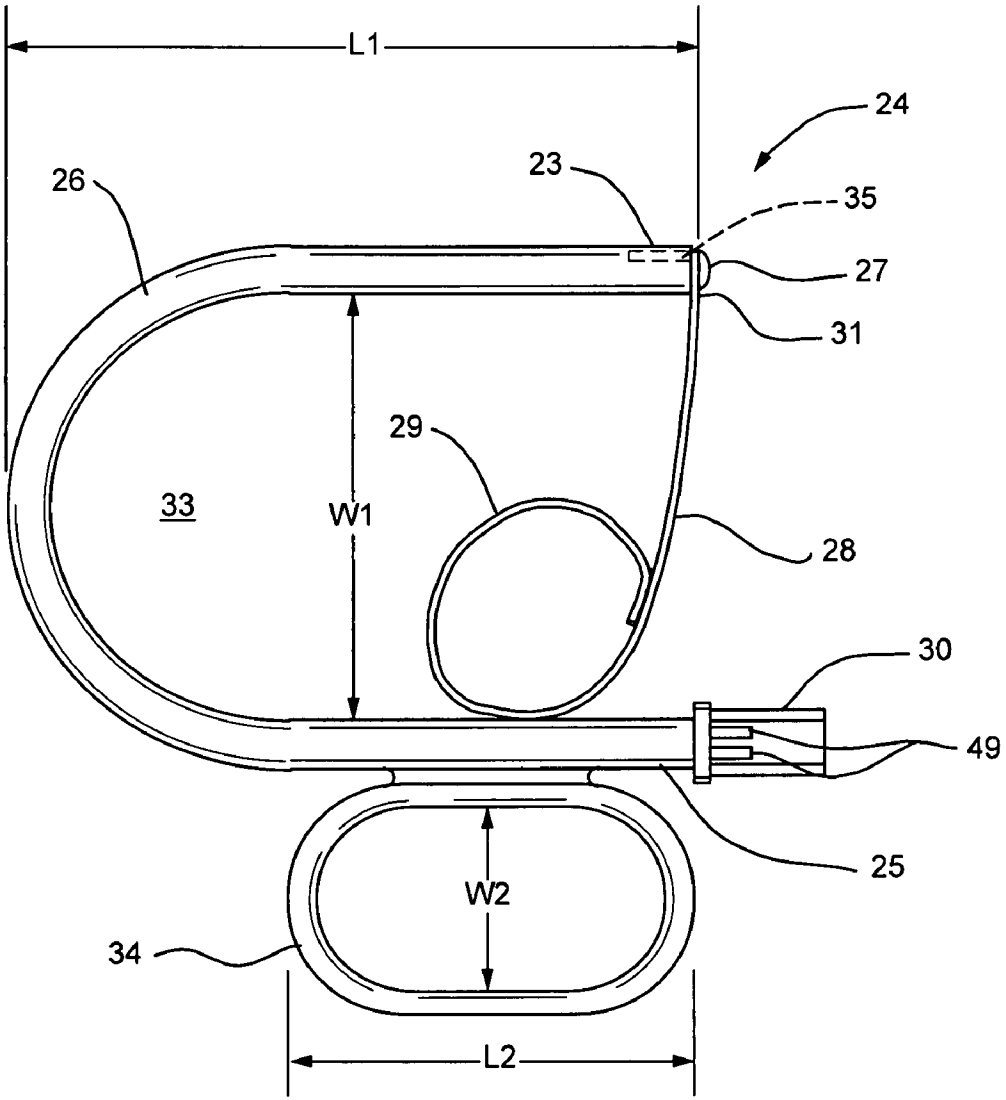
FIG. 3 is a side elevational view of a snap hook portion of the snap hook device according to the present invention.

Referring to FIG. 2 and FIG. 3, FIG. 3 shows a side elevational view of a snap hook 24 portion of the snap hook device 10 with the pole 38 and rope 36 removed. The width W1 between the parallel sides of the U-shaped hook 26 is approximately 2.75 inches, and the width W2 of the link 34 is approximately 1.0 inch in the present embodiment. The length L1 of the U-shaped hook 26 as shown in FIG. 3 is approximately 5.0 inches and the length L2 of the link is approximately 3.25 inches. The collar 30 is bonded on the end 25 of the U-shaped hook 26, and the collar 30 is provided to receive the pole 38 which may be a telescopic pole for additional reach capability. The inner telescoping portion 37 of pole 38 is preferably a hexagon shape and it may also be of other geometric shapes such as round. The pole 38 attaches to the collar 30 by clasp springs 39 & 41 so that the pole 38 may be easily disconnected from the snap hook 24. The removal of the pole 38 provides for easy maneuvering of the bow 13 of the boat 14 to be adjacent to the mooring buoy 16 without the pole 38 getting in the way. The U-shaped hook 26 is preferably made of stainless steel.

Still referring to FIG. 2 and FIG. 3, the spring closure 28 has one end 31 which is bent 90 degrees and inserted into a slot 35 and fastened to the end 23 of the U-shaped hook 26, and this prevents the otherwise open end 23 nose of U-shaped hook 26 from entering a link of the mooring chain 20 (FIG. 1).

The slope of the face of the spring closure 28 guides the mooring chain (or rope) 20 down the spring 28 toward the end 25 opening of the U-shaped hook 26. A round shaped coiled portion 29 of the spring closure 28 at the opening where it meets the U-shaped hook 26 guides the mooring chain (or rope) 20 along the inner side of U-shaped hook 26. Pressure of the spring closure 28 against the U-shaped hook 26 guides the mooring chain/rope 20 and prevents it from flipping over. The coiled portion 29 and the length of the side 25 of the U-shaped hook 26 are greater than a chain link's outer oval diameter to prevent the mooring chain 20 from flipping over when passing by the coiled portion 29 of the spring closure 28. The round coiled portion 29 of the spring closure 28 snaps the mooring chain/rope 20 into the U-shaped hook 26 capture area 33. The diameter of the round coiled portion 29 of the spring closure 28 is larger than the mooring chain link's inner oval diameter to prevent the coiled diameter of portion 29 from sliding into the mooring chain link 20. This round coiled portion 29 of the spring closure 28 expands and contracts as the shape of the U-shaped hook 26 opening expands and contracts due to forces on the hook. The coiled portion 29 is designed to keep constant pressure against the U-shaped hook 26 while preventing the spring coiled portion 29 from locking up with the side 25 of the U-shaped hook 26. The spring closure 28 may be embodied by a strip of 304 stainless steel, full hard, and in the present embodiment it is approximately 3.25 inches long with a radius of 6 inches extending down to the start of the coiled portion 29. The spring closure 28 measures approximately 0.50 inches wide and 0.033 inches thick.

Figure 7:
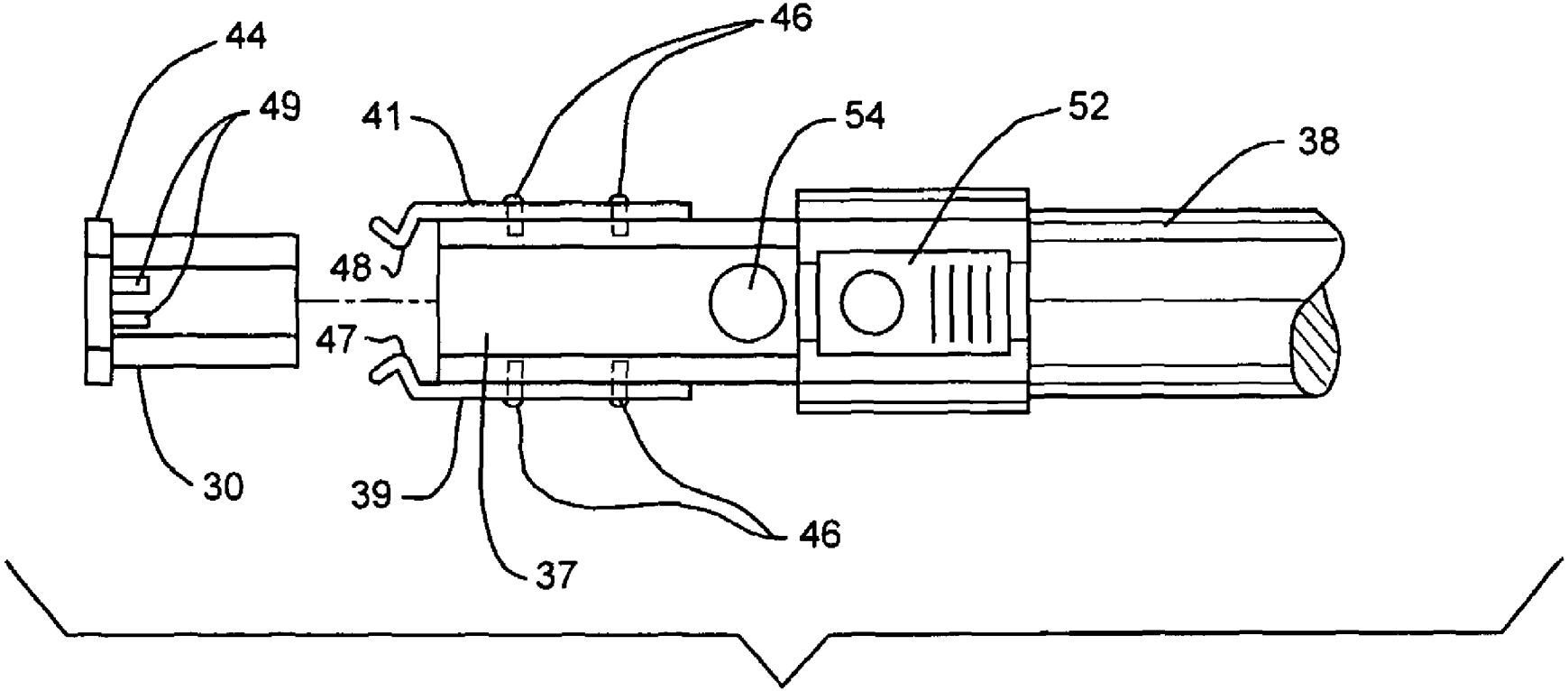
FIG. 7 is a side elevational view of a detachable connecting spring attached to an end of the pole and a collar on an end of the snap hook.

Referring to FIG. 7, a side elevational view of a detachable connecting spring on an end of the pole and a collar on an end of the snap hook. Clasp springs 39, 41 are attached to opposite sides of the pole 38 by stainless steel rivets 46 typically ⅛ inch in diameter. At the end of each clasp spring 39, 41, V sections 47, 48 are formed with the V sections pointed inwardly toward the center of pole 38.

Still referring to FIG. 7, a collar or sleeve 30 made typically of plastic is bonded to the end 25 of the U-shaped hook 26, and the collar 30 comprises a flange 44 at one end and a pair of tabs 49 to prevent the collar 30 from rotating once it is inserted into the pole opening which in the present embodiment is a hexagonal opening of a telescoping portion 37 of pole 38. The clasp springs 39, 41 and the collar 30 are aligned by markings such as a red dot (not shown) on each item and the collar 30 is pushed into the hexagonal extension portion 37 of pole 38 causing the V sections 47, 48 of the clasp springs, 39, 41 to deflect outward as they ride over the flange 44 of the collar 30 and deflect back inward after passing the flange 44. The snap hook 24 is now secured to the telescoping pole 38. Pulling pole 38 away from the snap hook 24 causes the flange 44 of collar 30 to deflect the V sections 47, 48 outward allowing the flange 44 to be released from being held by the V sections 47, 48 so that the collar 30 disconnects and separates from the telescoping pole 38. Therefore, the V sections 47, 48 of the clasp springs 39, 41 along with the collar 30 having the flange 44 provide the disconnecting means between the telescoping pole 38 and the snap hook 24. The telescoping portion 37 of pole 38 comprises a plurality of spaced apart holes 54 along its length for setting the length of the telescoping portion 37. A push button lever 52 is provided on the end of pole 38 that removes a stud from one of the holes 54 when it is necessary to re-adjust the length of the telescoping portion 37 of the pole 38.

Figure 4:
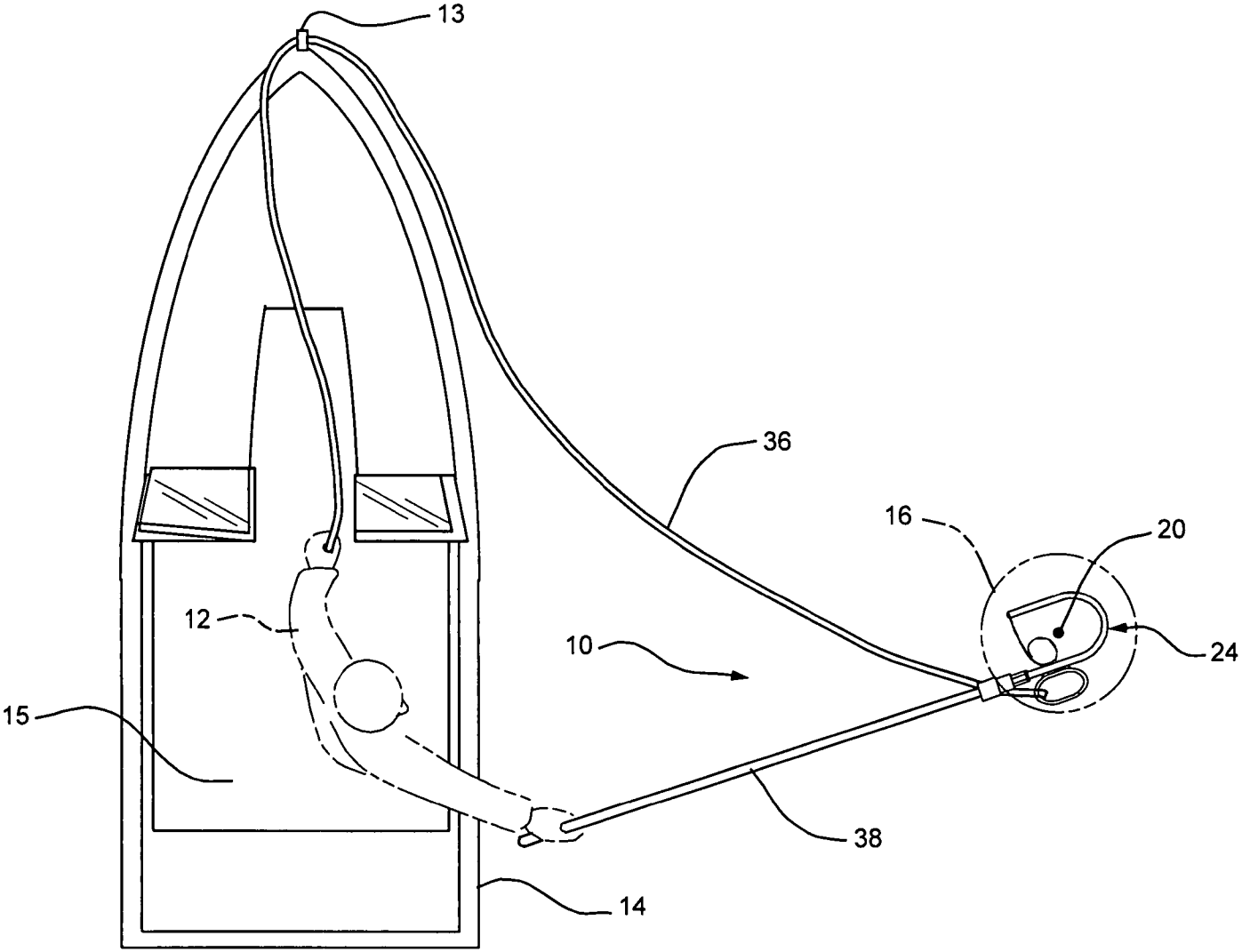
FIG. 4 is a top view of the boat, mooring buoy, and the snap hook device of FIG. 1 showing a rope extending from the snap hook device to the bow of a boat and back to an operator in the cockpit of the boat.

FIG. 4 is a top view of the boat 14, showing the boat operator 12 in the cockpit area 15, the mooring buoy 16, and the pole 38 and the rope 36 of the snap hook device 10. The snap hook device 10 enables the boat operator 12 to capture the chain under the mooring buoy 16 and position the bow 13 adjacent to the mooring buoy 16 without leaving the cockpit area 15 of the boat 14. This is particularly important for safety reasons if the operator 12 is alone in the boat 14 and has to maneuver the boat 14 close to the mooring buoy 16 before the boat hook device can be used to capture the chain 20 attached under the mooring buoy 16. The snap hook device 10 enables the operator to remain in the cockpit area 15 and not have to leave it and go to the bow 13 of the boat to grab the mooring buoy 16, thereby being able to further maneuver the boat 14 closer to the mooring buoy 16 if necessary. FIG. 4 shows the operator holding the handle or pole 38 of the snap hook device 10 in one hand and the rope 36, which is attached to the snap hook device 10, in the other hand.

Figure 5:
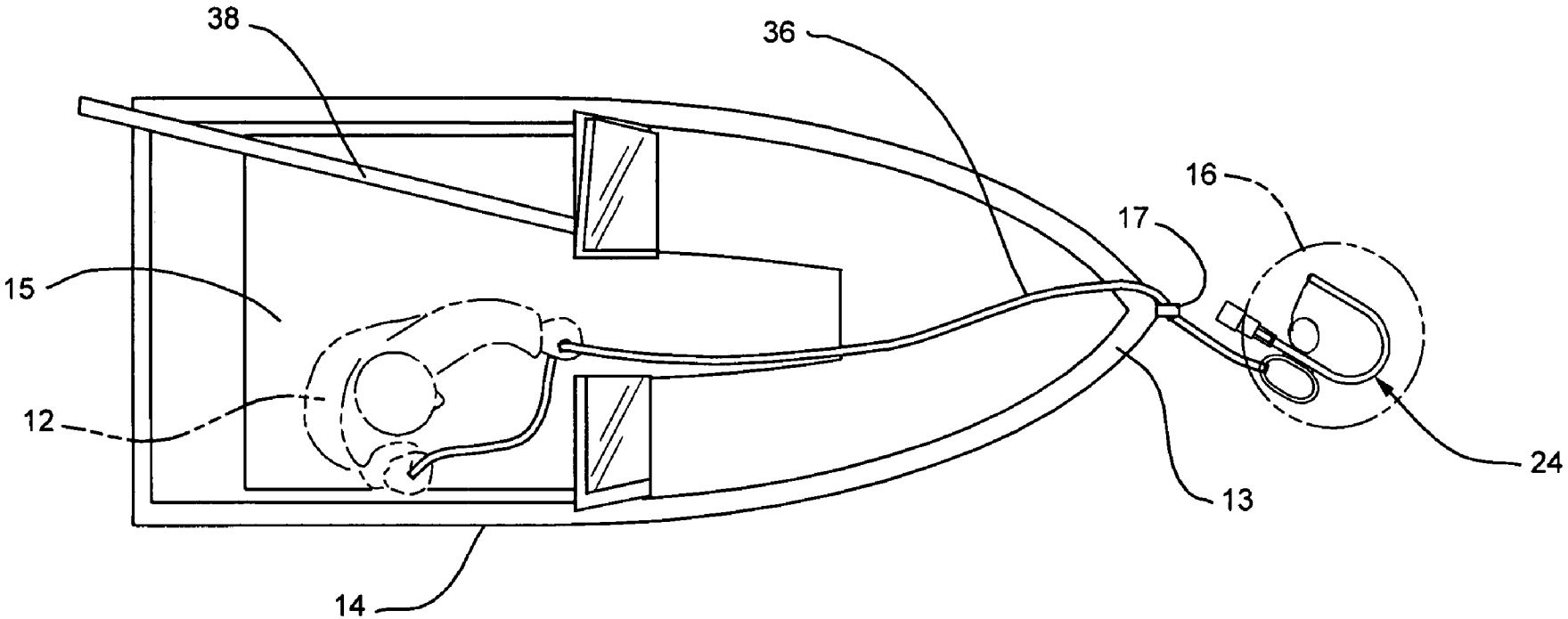
FIG. 5 is a top view of the boat and the mooring buoy illustrating the bow of a boat being positioned adjacent to the mooring buoy by an operator pulling a rope of the snap hook device while the snap hook is attached to a chain under the mooring buoy.

Referring to FIG. 4 and FIG. 5, a top view of the boat operator 12, the boat 14, the snap hook device 10 attached under the mooring buoy 16, and the mooring buoy 16 is shown, and FIG. 5 illustrates how the bow 13 of the boat 14 is easily moved by the boat operator 12 to be adjacent to the mooring buoy 16 by pulling on the rope 36 after the pole 38 is detached from the snap hook device 10. The rope 36 extends from the snap hook device 10 to a bow ring 17 or chock on the bow 13 and then to the operator 12 in the cockpit area 15. The operator 12 has complete control of the boat 14 and the mooring buoy 16. The operator 12 can move to the bow of the boat 14 and safely reach over and grab the mooring rope 18 (FIG. 1) attached to the mooring buoy 16 and connect it to the ring 17 or cleat on the bow 13 of the boat 14.

Figure 6:
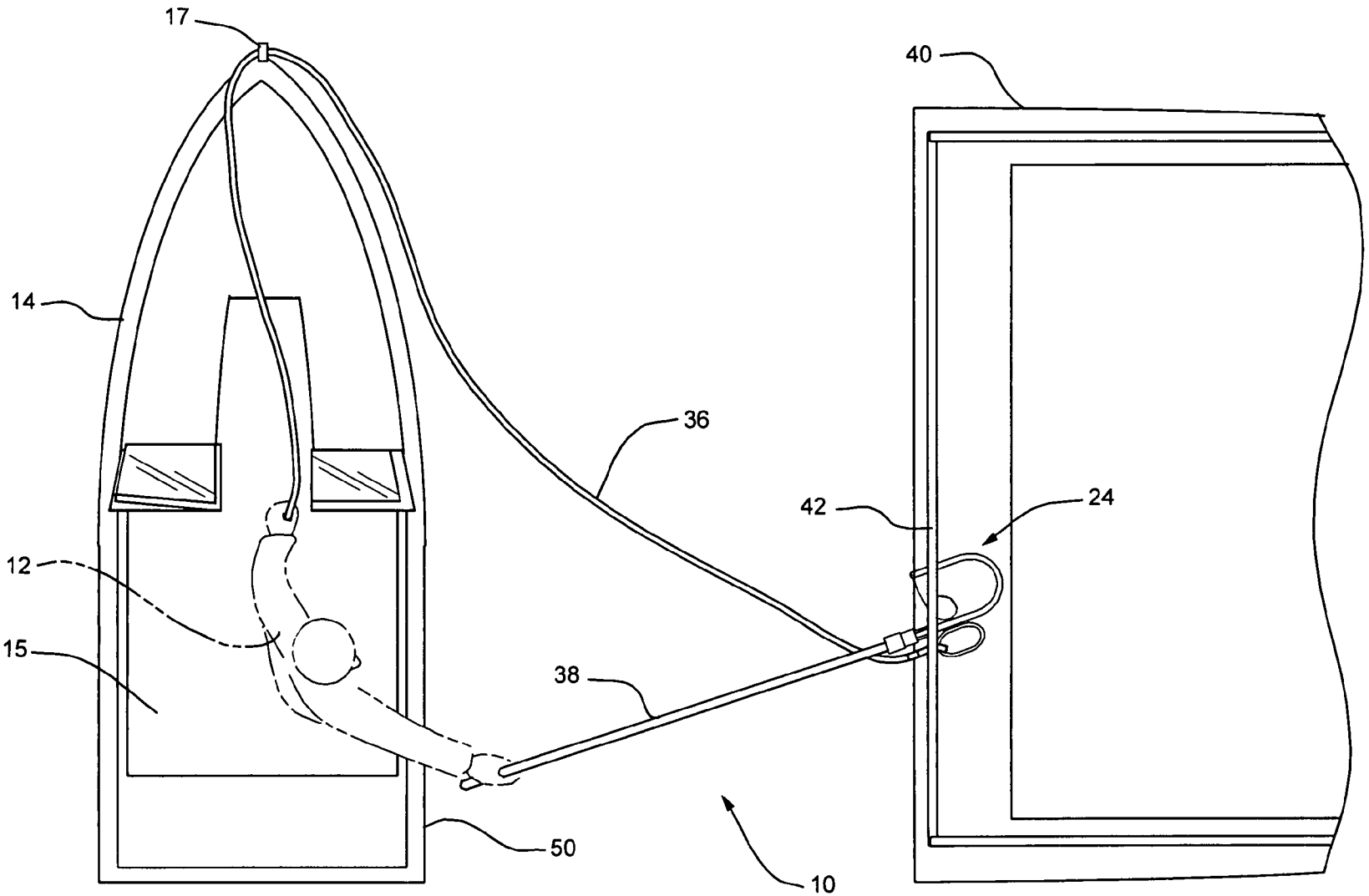
FIG. 6 is a top view of a detachable snap hook device attached to a rail of a vessel for securing a tender to the side of the vessel.

Referring to FIG. 6, a top view of the snap hook device 10 is shown attached to a rail of a vessel 40 for securing a boat 14 or tender to the side of the vessel 40. The snap hook device 10 enables the boat 14, especially when only an operator is in the boat 14, to be safely controlled and at the same time capture a rail 42 of the vessel 40, and the operator by means of the rope 36 of the snap hook device 10 can pull the vessel 14 adjacent to vessel 40 for tie up adjacent to the vessel 40.

This invention has been disclosed in terms of certain embodiment. It will be apparent that many modifications can be made to the disclosed apparatus without departing from the invention. Therefore, it is the intent of the appended claims to cover all such variations and modifications as come within the true spirit and scope of this invention.

What is claimed is:

1. A snap hook device comprising:

a U-shaped hook including a nose end and a body end;

a spring closure positioned across an open portion of said U-shaped hook, said spring closure comprises a first end attached to said nose end of said U-shaped hook and a second end having a coiled portion with a predetermined diameter larger than an opening in a mooring chain under a mooring buoy;

said coiled portion of said second end of said spring closure rests against an inside surface of the body end of said U-shaped hook thereby closing said open portion of said U-shaped hook and said coiled portion moves within said U-shaped hook when an external force is applied to said spring closure;

a link attached to an outside surface of said U-shaped hook;

a collar attached to said body end of said U-shaped hook; and a pole attached to said collar.

2. The snap hook device as recited in claim 1 wherein said device comprises a boat rope attached to said link.

3. The snap hook device as recited in claim 1 wherein said pole comprises a telescopic pole.

4. The snap hook device as recited in claim 1 wherein an extension portion of said pole comprises a hexagonal shape.

5. The snap hook device as recited in claim 1 wherein said pole comprises means for connecting to said collar in a manner that is readily detachable.

6. The snap hook device as recited in claim 1 wherein said collar attached to said body end of said U-shaped hook comprises means for enabling said pole to be attached and detached from said U-shaped snap hook.

7. An apparatus for assisting an operator in mooring a boat comprising:

a snap hook device for capturing a mooring chain under a mooring buoy;

said snap hook device comprises a spring closure positioned across an open portion of a U-shaped hook, said spring closure comprises a first end attached to a nose end of said U-shaped hook and a coiled spring on an unattached second end resting against an inside surface of a body end of said U-shaped hook, said coiled spring having a predetermined diameter larger than an opening in said mooring chain and said coiled spring moves within said U-shaped hook when a force provided by said mooring chain is applied to said spring closure;

means for disconnecting a pole from said snap hook device after said mooring chain is captured within said U-shaped hook under said mooring buoy; and said snap hook device comprises a boat rope attached to a link on an outside surface of said U-shaped hook, said boat rope being of a length to extend to guide means at a bow of said boat then to said boat operator located in a cockpit area of said boat adjacent to said snap hook device.

8. The apparatus as recited in claim 7 wherein said guide means attached to said bow of said boat guides said boat rope extended to said boat operator for maneuvering said bow of said boat to be adjacent to said mooring.

9. The apparatus as recited in claim 7 wherein said spring closure comprises said first end inserted in a slot of said nose end of said U-shaped hook and said second end comprises said coiled spring which rests against an inside surface of an opposite side of said U-shaped hook adjacent to a collar.

10. The apparatus as recited in claim 7 wherein an extension portion of said pole comprises a hexagonal shape.

11. The apparatus as recited in claim 7 wherein said pole comprises a pair of clasp springs attached to opposite sides of a detachable end of said pole adjacent to said body end of said U-shaped hook.

12. A method for providing a snap hook device comprising the steps of:

providing a U-shaped hook having a nose end and a body end;

positioning a spring closure across an open portion of said U-shaped hook comprising a first end attached to said nose end of said U-shaped hook and a second end having a coiled spring with a predetermined diameter larger than an opening in a chain under a mooring buoy to prevent hooking into said chain;

closing said open portion of said U-shaped hook with said coiled portion of said second end of said spring closure which rests against an inside surface of said body end of said U-shaped hook and moves inward when an external force is applied to said spring closure;

providing a link on an outside surface of said U-shaped hook;

attaching a collar to said body end of said U-shaped hook; and connecting a detachable pole to said collar.

13. The method as recited in claim 12 wherein said method comprises the step of attaching a rope to said link.

14. The method as recited in claim 12 wherein said step of connecting a pole to said collar comprises the step of connecting a telescopic pole.

15. The method as recited in claim 12 wherein said step of connecting a pole comprises the step of connecting a hexagonal-shaped extension portion of said pole.

16. The method as recited in claim 12 wherein said step of connecting a pole to said collar comprises the step of enabling said pole to be quickly detached from said U-shaped snap hook.

* * * * *